US008066434B2

(12) United States Patent
Nanba et al.

(10) Patent No.: US 8,066,434 B2
(45) Date of Patent: Nov. 29, 2011

(54) CHUCK TAPE WITH CUT TAPE, ITS MANUFACTURING METHOD, AND PACKAGING BAG WITH CHUCK TAPE

(75) Inventors: Yoshinori Nanba, Chiba (JP); Kenichi Tanaka, Chiba (JP)

(73) Assignee: Idemitsu Unitech Co., Ltd., Tokyo (JP)

( * ) Notice: Subject to any disclaimer, the term of this patent is extended or adjusted under 35 U.S.C. 154(b) by 420 days.

(21) Appl. No.: 12/438,224

(22) PCT Filed: Aug. 17, 2007

(86) PCT No.: PCT/JP2007/065995

§ 371 (c)(1),
(2), (4) Date: Feb. 20, 2009

(87) PCT Pub. No.: WO2008/023631

PCT Pub. Date: Feb. 28, 2008

(65) Prior Publication Data

US 2010/0236026 A1 Sep. 23, 2010

(30) Foreign Application Priority Data

Aug. 21, 2006 (JP) ..... 2006-224254

(51) Int. Cl.
*B65D 33/00* (2006.01)
*B65D 33/16* (2006.01)

(52) U.S. Cl. ..... 383/204; 383/205; 383/61.2; 383/63; 383/65; 383/66

(58) Field of Classification Search ..... 383/203–206, 383/63, 65, 66, 61.2
See application file for complete search history.

(56) References Cited

U.S. PATENT DOCUMENTS 5,036,643 A * 8/1991 Bodolay ..... 53/128.1
5,215,380 A * 6/1993 Custer et al. ..... 383/203
5,470,156 A * 11/1995 May ..... 383/210
5,486,051 A * 1/1996 May ..... 383/200
(Continued)

FOREIGN PATENT DOCUMENTS

JP 06092362 A 4/1994
(Continued)

OTHER PUBLICATIONS

Supplementary European Search Report for EP Application No. 07792619 dated Sep. 3, 2010.

*Primary Examiner* — Jes F Pascua
(74) *Attorney, Agent, or Firm* — Millen, White, Zelano & Branigan, P.C.

(57) ABSTRACT

A belt-shaped base of a female member of a zipper tape attached to an inner surface of a bag body has a wide portion that extends wider toward an opening of the bag body than a belt-shaped base of the male member. An open tape is disposed on the wide portion and a seal layer is laminated on a surface of the open tape. A first projecting portion is also provided on the wide portion. A second projecting portion is provided on an opening-side end of the belt-shaped base. The projecting portions have a substantially trapezoidal cross section. When the zipper tape is bonded to the bag body and is sealed by the seal layer, a gap is provided between the open tape and the first and the second projecting portions.

7 Claims, 7 Drawing Sheets

U.S. PATENT DOCUMENTS

| | | | | |
|---|---|---|---|---|
| 5,660,479 | A * | 8/1997 | May et al. | 383/204 |
| 5,672,009 | A | 9/1997 | Malin et al. | |
| 5,887,980 | A * | 3/1999 | May | 383/204 |
| 5,893,645 | A * | 4/1999 | May | 383/208 |
| 5,904,425 | A * | 5/1999 | May | 383/203 |
| 6,361,212 | B1 * | 3/2002 | Sprehe et al. | 383/63 |
| 7,476,030 | B1 * | 1/2009 | Kuge et al. | 383/203 |
| 7,597,480 | B2 * | 10/2009 | Kuge et al. | 383/205 |
| 2004/0131283 | A1 * | 7/2004 | Sprague et al. | 383/61.2 |
| 2005/0286811 | A1 * | 12/2005 | Sprague et al. | 383/61.2 |
| 2005/0286812 | A1 * | 12/2005 | Sprague et al. | 383/61.2 |
| 2007/0062157 | A1 * | 3/2007 | Plourde et al. | 53/138.4 |
| 2009/0022435 | A1 * | 1/2009 | Tanaka et al. | 383/210.1 |
| 2009/0238500 | A1 * | 9/2009 | Nanba et al. | 383/203 |
| 2010/0266224 | A1 * | 10/2010 | Nanba et al. | 383/204 |

FOREIGN PATENT DOCUMENTS

| | | | |
|---|---|---|---|
| JP | 06092362 | W | 4/1994 |
| JP | 07013746 | T | 3/1995 |
| JP | 07013746 | U | 3/1995 |
| JP | 08212817 | A | 3/1998 |
| JP | 10059384 | A | 3/1998 |
| JP | 10059384 | W | 3/1998 |
| JP | 2000355336 | A | 12/2000 |
| JP | 2000355336 | W | 12/2000 |
| JP | 2004276925 | A | 10/2004 |
| JP | 2004276925 | W | 10/2004 |
| JP | 2006008211 | A | 1/2006 |
| JP | 2006008211 | W | 1/2006 |
| WO | 2008023631 | R | 11/2007 |

* cited by examiner

CHUCK TAPE WITH CUT TAPE, ITS MANUFACTURING METHOD, AND PACKAGING BAG WITH CHUCK TAPE

TECHNICAL FIELD

The present invention relates to a zipper tape provided with an open tape, manufacturing method thereof and a package bag provided with the zipper tape.

BACKGROUND ART

As a package for packaging various articles such as food, medicine, medical products and miscellaneous goods, package bags provided with a zipper tape have been used, in which a pair of belt-shaped zipper tapes respectively including a male member and a female member that are mated with each other is disposed on an opening, the zipper tapes capable of being opened from the mated state and closable again.

Such package bags provided with a zipper tape are sealed at an upper part of the zipper tape. When the package bags are to be opened, a film forming a bag body is capable of being torn apart starting from notches and the like provided on both sides of the package bag.

When the package bag is to be thus opened, since the film is cut at a position adjacent to the zipper tape, it become difficult to pinch the bag body. Accordingly, a technique has been desired that allows the film of the bag body to be cut at a predetermined position.

In view of the above, several methods have been proposed.

In Patent Document 1, an opening string is disposed on a part of a zipper tape. The opening string is pulled to tear a film of the bag body.

In Patent Document 2, an open tape is provided and a film of the bag body is cut together with the open tape.

In Patent Document 3, in order to cut an open tape at a predetermined position, a cylindrical guide piece is provided on both ends of the open tape or, alternatively, the thickness of the both ends of the open tape is increased.

[Patent Document 1] JP-A-2004-276925

[Patent Document 2] JP-A-2000-355336

[Patent Document 3] JP-A-10-059384

DISCLOSURE OF THE INVENTION

Problems to be Solved by the Invention

However, the above-mentioned methods have problems of their own.

In Patent Document 1, since the open tape is disposed on a part of the zipper tape, in order to tear the film with the open tape, a part or the entirety of the zipper tape has to be simultaneously cut, which is difficult for children and aged men.

In Patent Document 2, molten resin generated when the zipper tape is sealed onto the bag body advances near to the open tape, thus unable to be cut. Further, when the zipper tape is too thin, the zipper tape is cut together with the open tape.

In Patent Document 3, when a base material difficult to be cut is used, the base material is often cut together with the guide piece.

An object of the invention is to provide a zipper tape provided with an open tape that allows a package bag to be opened at a predetermined position when the package bag is opened by tearing an upper part of the zipper tape, a manufacturing method of the zipper tape and a package bag provided with the zipper tape.

Means for Solving the Problems

A zipper tape according to an aspect of the invention is attached to an inner surface of a package bag, the zipper tape including: an engagement portion at which a pair of male member and a female member are mated with each other; and belt-shaped bases provided continuously to the engagement portion, in which one of the belt-shaped bases has a wide portion that extends wider toward an opening of the package bag than the other of the belt-shaped bases, an open tape is laminated on a surface of the wide portion adjacent to the engagement portion, a seal layer that is adapted to be bonded to the bag body is provided on a surface of the open tape, a first projecting portion is provided on the wide portion at a position adjacent to the opening of the package bag and remote from the open tape, a second projecting portion is provided on an opening-side end of the other of the belt-shaped bases on which the open tape is not provided, and the first projecting portion, the seal layer laminated on the open tape and a surface of the other of the belt-shaped bases opposite to the engagement portion are adapted to be bonded to the inner surface of the bag body while providing a gap between the open tape and the first and the second projecting portions.

According to the above aspect of the invention, since the first projecting portion is provided on the wide portion at a position remote from the open tape and the second projecting portion is provided on the opening-side end of the other of the belt-shaped bases without having the open tape, when the zipper tape is bonded to the inner surface of the bag body and the seal layer and the first projecting portion are bonded to the opposing bag body to seal the bag, a gap is provided between the open tape and the first and the second projecting portions.

Accordingly, even when molten resin generated when the seal layer is bonded to the bag body is laterally spread, the presence of the gap prevents the open tape from being united with the zipper tape. Thus, the bag body can be easily cut together with the open tape.

In the zipper tape according to the above aspect of the invention, the gap is preferably so formed that a distance between the open tape and the first projecting portion and a distance between the open tape and the second projecting portion are respectively 0.5 mm or more.

According to the above arrangement, since the gap formed between the open tape and the first and the second projecting portions provides a distance of 0.5 mm or more between the open tape and the first and the second projecting portions, the molten resin generated when being bonded does not reach to the open tape. Thus, the gap can be reliably provided so that the film of the bag body can be easily cut together with the open tape at a predetermined position.

When the distance between the open tape and the first and the second projecting portions is smaller than 0.5 mm, since the molten resin generated when the zipper tape is bonded to the bag body has no way out, the open tape and the zipper tape are united. As a result, when the open tape is to be pinched to cut the bag body, the bag body cannot be cut on account of excessive resistance or the bag body is cut together with the zipper tape, where the cutting position is unstable.

The distance between the open tape and the first and the second projecting portions is preferably 5 mm or less. When the distance exceeds 5 mm, the width of the zipper tape itself is widened, which deteriorates the appearance and is also not practical.

In the zipper tape according to the above aspect of the invention, it is preferable that the first projecting portion and the second projecting portion are substantially trapezoidal in cross section.

According to the above arrangement, since the first projecting portion and the second projecting portion provided on the belt-shaped bases of the zipper tape are substantially trapezoidal in cross section, the thickness of the zipper tape located on both sides of the open tape when the bag is sealed is increased both heightwise and widthwise as compared with an arrangement without the projecting portions. The height is preferably 250 μm or more and, more preferably, 300 μm or more.

Accordingly, when the film of the bag body is to be cut, the zipper tape is not cut or stretched.

Further, since the projecting portions have substantially trapezoidal cross sections, the molten resin generated during the bonding is likely to be accumulated on a short-side of the trapezoid, so that the gap between the open tape and the first and the second projecting portions can be reliably provided.

In the zipper tape according to the above aspect of the invention, it is preferable that the first projecting portion and the second projecting portion are substantially rectangular in cross section.

According to the above arrangement, since the projecting portions are substantially rectangular or trapezoidal in cross section, the thickness of the projecting portion is increased both heightwise and widthwise as compared with an arrangement without the projecting portions. The height is preferably 250 μm or more and, more preferably, 300 μm or more.

Accordingly, the same advantages as described above can be obtained.

In the zipper tape according to the above aspect of the invention, it is preferable that the open tape is laminated on either one of the male member and the female member.

According to the above arrangement, since the open tape is laminated on either one of the male member and the female member of the zipper tape, the open tape can be laminated simultaneously with producing the zipper tape. Thus, the zipper tape provided with the open tape can be obtained in one step, so that the work load and production cost can be reduced.

On a package bag according to another aspect of the invention, the zipper tape according to the above aspect of the invention is attached.

Since the above zipper tape provided with the open tape is attached to the package bag provided with the zipper tape according to the above aspect of the invention, the same advantages as the above can be obtained.

A manufacturing method of a zipper tape according to still another aspect of the invention includes co-extruding a material of the zipper tape, a material of the open tape and a material of the seal layer.

According to this aspect of the invention, the zipper tape provided with the open tape can be obtained in one step, so that the work load and production cost can be reduced.

BEST MODE FOR CARRYING OUT THE INVENTION

Exemplary embodiment(s) of the invention will be described below with reference to the attached drawings. In the description of the embodiment(s), the explanation of the components with the same reference sign will be simplified or omitted.

First Embodiment

Initially, a first exemplary embodiment of the invention will be described below with reference to FIGS. 1 to 3.

Figure 1:
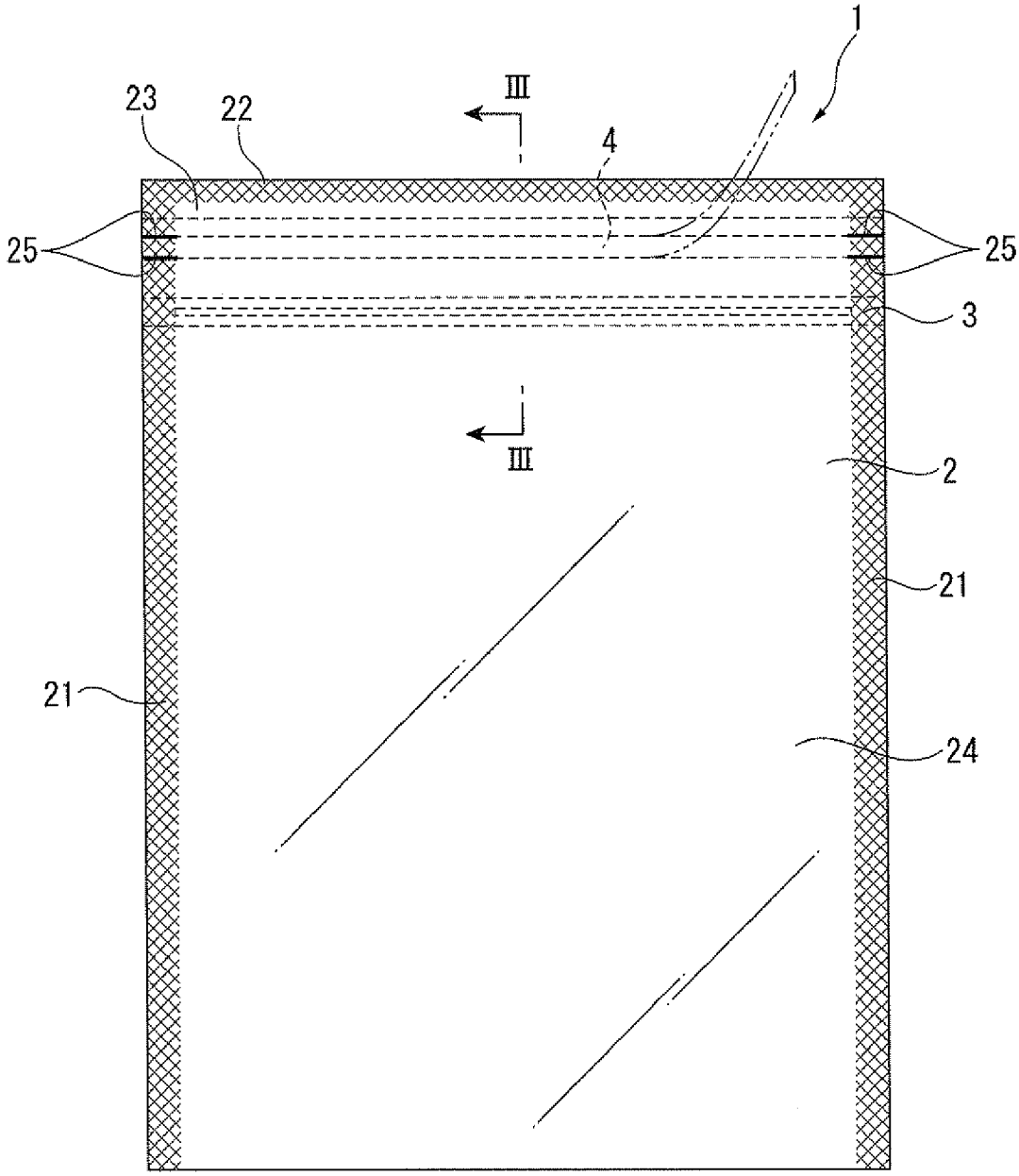
FIG. 1 is a front elevational view showing a package bag provided with a zipper tape according to a first exemplary embodiment of the invention.

FIG. 1 is a front elevational view showing a package bag provided with a zipper tape according to the first exemplary embodiment of the invention. FIG. 2 is a cross section showing the zipper tape of the first exemplary embodiment before being bonded to a bag body. FIG. 3 is a cross section taken along III-III line in FIG. 1 showing the zipper tape being bonded to the bag body to seal the bag.

As shown in FIG. 1, the package bag 1 provided with a zipper tape according to the exemplary embodiment includes a bag body 2 provided by overlaying base material films 24 (package material) with each other and forming side seal portions 21 and a top seal portion 22 on the periphery thereof. A zipper tape 3 is attached to an inner surface of an opening 23 of the bag body 2.

Figure 2:
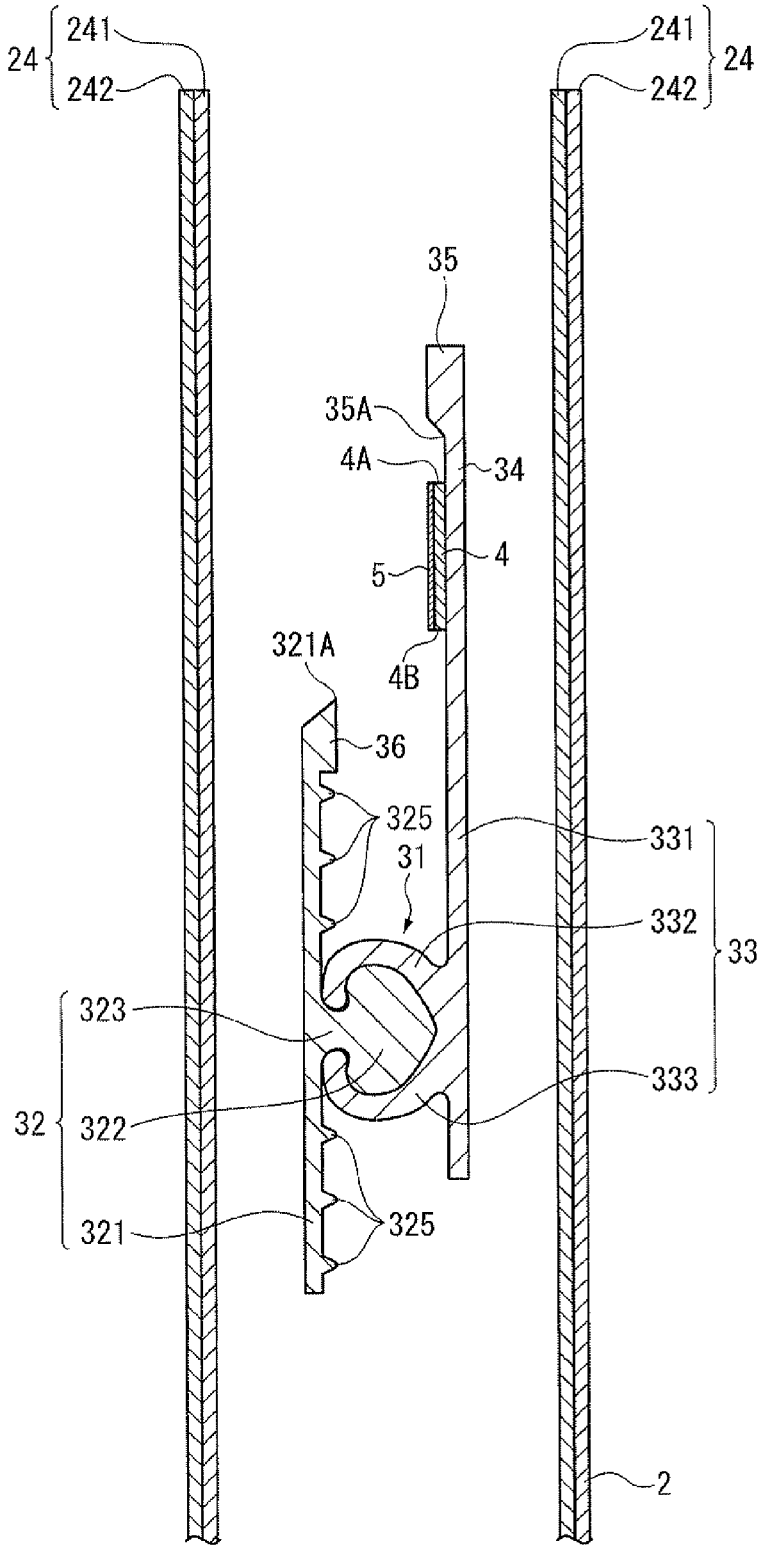
FIG. 2 is a cross section showing the zipper tape of the first exemplary embodiment before being bonded to a bag body.

As shown in the cross section of the zipper tape 3 in FIG. 2, the zipper tape 3 includes a pair of a male member 32 and a female member 33. The male member 32 has an united arrangement of a belt-shaped base 321 bonded to the bag body 2, a head 322 having a substantially arrow-tip shaped cross section, and a connecting portion 323 for connecting the belt-shaped base 321 and the head 322. Similarly to the above-described male member 32, the female member 33 includes a belt-shaped base 331 bonded to the bag body 2, and a first and second hooking portions 332 and 333 connected to the belt-shaped base 331 and provided with an arc cross section. The first hooking portion 332 and the second hooking portion 333 are opposed with each other.

An engagement portion 31 of the zipper tape 3 is provided by the head 322 of the male member 32 and the first and the second hooking portions 332 and 333 of the female member 33, which are disengaged and engaged to open and re-close the bag.

The belt-shaped base 331 united with the female member 33 has a wide portion 34 that is wider toward the opening of the bag body 2 than the belt-shaped base 321 united with the male member 32.

An open tape 4 is disposed on the wide portion 34 parallel to a longitudinal direction of the wide portion 34. A seal layer 5 to be bonded to a base material film 24 of the opposing bag body 2 is provided on a surface of the open tape 4.

A first projecting portion 35 is also provided on the wide portion 34 at a position adjacent to the opening and remote from the open tape 4. The first projecting portion 35 may be formed in any shape as long as the first projecting portion 35 provides a thick profile. In this exemplary embodiment, the first projecting portion 35 is provided with a substantially trapezoidal cross section. A distance between an end 35A of the first projecting portion 35 adjacent to the open tape and an end 4A of the open tape 4 adjacent to the opening is preferably 0.5 mm or more and 5 mm or less. In this exemplary embodiment, the distance is 1.0 mm.

On the other hand, a second projecting portion 36 is provided on an opening-side end 321A of the other belt-shaped base 321 having no wide portion 34. The second projecting portion 36 also has a substantially trapezoidal cross section.

The length of the belt-shaped base 321 is preferably determined so that a distance between a content-side end 4B of the open tape 4 and the opening-side end 321A of the belt-shaped base 321 is 0.5 mm or more and 5 mm or less when the seal layer 5 is bonded to the opposing bag body 2. In this exemplary embodiment, the length of the belt-shaped base 321 is 1.0 mm.

A plurality of triangular projections 325 are provided on a surface of the belt-shaped base 321 adjacent to the engagement portion 31. The triangular projections 325 improve sealability of the bag and facilitate pinching of the bag.

Figure 3:
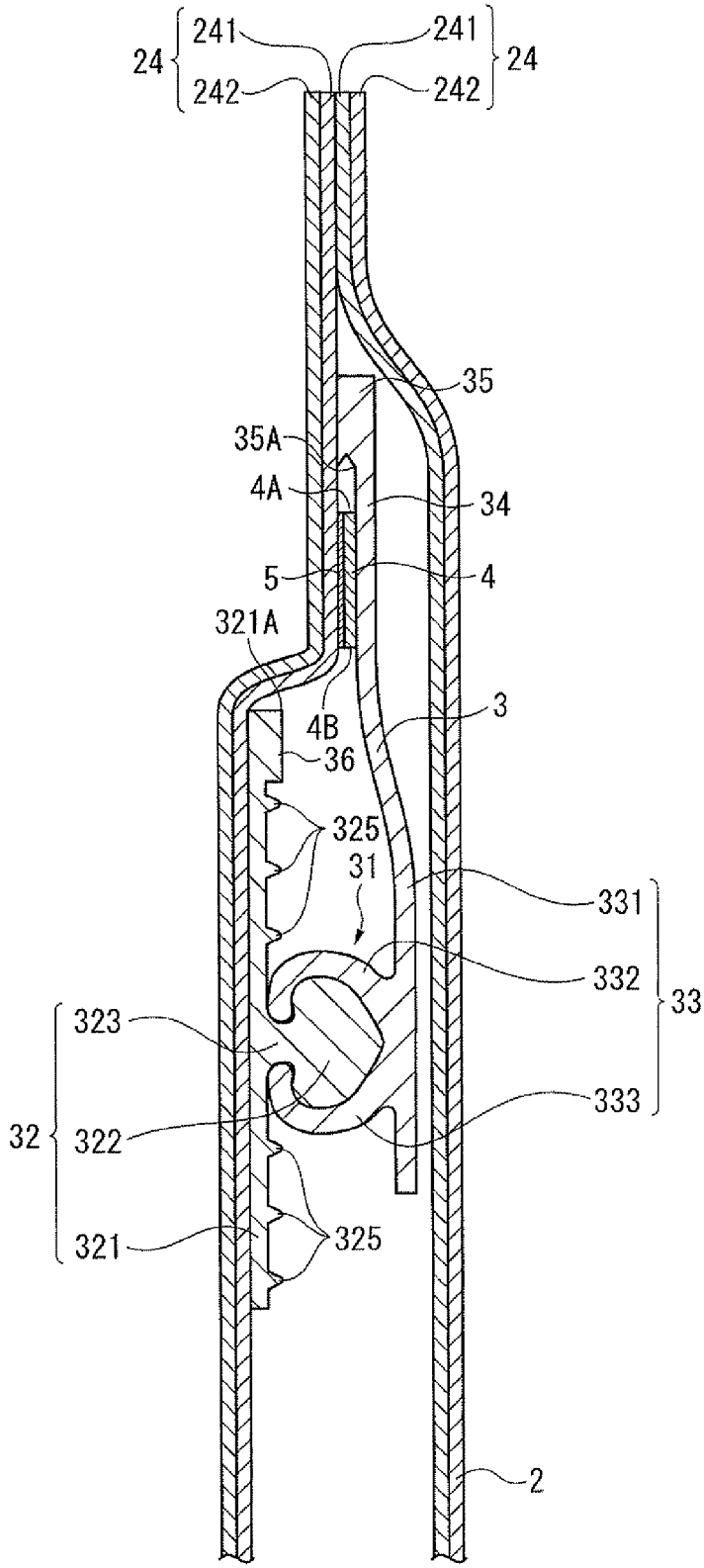
FIG. 3 is a cross section taken along III-III line in FIG. 1 showing the zipper tape being bonded to the bag body to seal the bag.

As shown in FIG. 3, the surface of the belt-shaped base 321 opposite to the engagement portion 31 is sealed to the inner surface of the opposing bag body 2. Further, the first projecting portion 35 of the wide portion 34 and the seal layer 5 are bonded to the opposing bag body 2 so that the package bag 1 provided with the zipper tape is sealed. Incidentally, the package bag 1 provided with the zipper tape is sealed by sealing a bottom side of the bag body 2 after a content (not shown) is packed in the bag body 2 from the bottom side.

The male member 32 of the zipper tape 3 of this exemplary embodiment can be integrally provided by co-extruding the belt-shaped base 321, the head 322 continuous with the belt-shaped base 321, the connecting portion 323, the triangular projection 325 and the second projecting portion 36. Similarly, the female member 33 can be integrally provided by co-extruding the belt-shaped base 331, the first hooking portion 332 continuous with the belt-shaped base 331, the second hooking portion 333, the first projecting portion 35, the open tape 4 laminated on the wide portion 34 of the belt-shaped base 331 and the seal layer 5. With the use of such a co-extrusion method for producing the zipper tape 3, the manufacturing step can be simplified, the production cost can be reduced and the zipper tape 3 can be stably and continuously produced.

The male member 32 and the female member 33 of the zipper tape 3 are preferably formed by polyethylene-base resins such as low-density polyethylene, polypropylene-base resins and polyolefin resins including a copolymer of polyethylene and polypropylene. Examples of the polypropylene-base resins are thermoplastic resin such as homo-polypropylene, block polypropylene, random polypropylene (RPP), propylene-ethylene-butene-1-random ternary copolymer, polyolefinic specialty soft resin (TPO resin. e.g. prime polymer TPO), and a mixture of the resins.

The open tape 4 is formed by a different resin incompatible with the open tape 3, examples of which are oriented polyethylene terephthalate (OPET), oriented polypropylene (OPP) and oriented high-density polyethylene (HDPE).

Further, the seal layer 5 is provided in order to bond the open tape 4 onto the bag body 2, preferable material of which is Metallocene LL.

The base material film 24 (package material) forming the bag body 2 is preferably a laminate film in which a sealant layer 241 is laminated on a base layer 242. However, in accordance with the performance desired, a laminate film in which an intermediate layer (not shown) such as a gas-barrier layer, light-shielding layer and strength-improving layer is laminated between the base layer 242 and the sealant layer 241 may alternatively be used.

As well as biaxially oriented polypropylene film (OPP film), a biaxially oriented polyester film such as a biaxially oriented polyethylene terephthalate film (PET film) and a biaxially oriented polyethylene naphthalate film (PEN film), and a biaxially oriented polyamide film such as nylon 6, nylon 66 and MXD6 (poly-(meta-xylylene adipamide)) can be suitably used for the base layer 242. Alternatively, various engineering plastic films may be used as necessary. These films may be singularly used or a combination of a plurality of the films may be used.

When the intermediate layer is a gas-barrier layer, the intermediate layer may be provided by a film of ethylene-vinyl acetate copolymer (EVOH), polyvinylidene chloride (PVDC), polyacrylonitrile (PAN), aluminum foil, a vapor-deposition layer of silica, alumina, aluminum and the like, or a coating layer of PVDC.

When a vapor-deposition layer of silica, alumina and aluminum or a coating film layer of PVDC is used as the intermediate layer, the intermediate layer may be vapor-deposited or coated on the inner surface of the base layer 242. Alternatively, the layer may be vapor-deposited or coated on a separate biaxially oriented nylon film (ONy film), biaxially oriented polyethylene terephthalate film (PET film), biaxially oriented polypropylene film (OPP film) and the like and thus prepared film may be laminated on the intermediate layer.

In the above, since aluminum foil and aluminum vapor-deposited layer are opaque, aluminum foil and aluminum vapor-deposited layer can also work as a light-shielding layer.

When the base layer 242 and the film of the intermediate layer are laminated, known dry lamination method or extrusion lamination method (sandwich lamination method) may be employed.

Low-density polyethylene, polypropylene (CPP) and the like can be used as the innermost sealant layer 241.

Incidentally, in order to laminate the sealant layer 241, the above resins may be formed as a film, which is to be laminated by a dry lamination or an extrusion lamination. Alternatively, the above resins may be laminated by extrusion coating to obtain the base material film 24.

With the use of thus obtained base material film 24 and the zipper tape 3, the package bag 1 provided with the zipper tape is manufactured using a zipper-tape-attaching three-side seal bag-making machine and the like.

The zipper-tape-attaching three-side seal bag-making machine includes a package material feeder, a tape feeder and a zipper tape bonding section. After the pair of base material films 24 are fed from the package material feeder, the zipper tape 3 fed from the tape feeder is disposed between the pair of the base material films 24 and the zipper tape 3 and the base material films 24 are bonded at the zipper tape bonding section. Subsequently, the base material films 24 are transferred to be bonded and melt-cut at a predetermined interval in the transferring direction of the base material film 24 to form the package bag 1 provided with the zipper tape.

The seal layer 5 laminated on the surface of the open tape 4 and the first projecting portion 35 may be bonded to the opposing base material film 24 simultaneously with bonding the zipper tape 3 onto the base material film 24 by the tape bonding section. Accordingly, since no new bag-making machine is required for implementing the invention, work load and production cost can be reduced.

Figure 4:
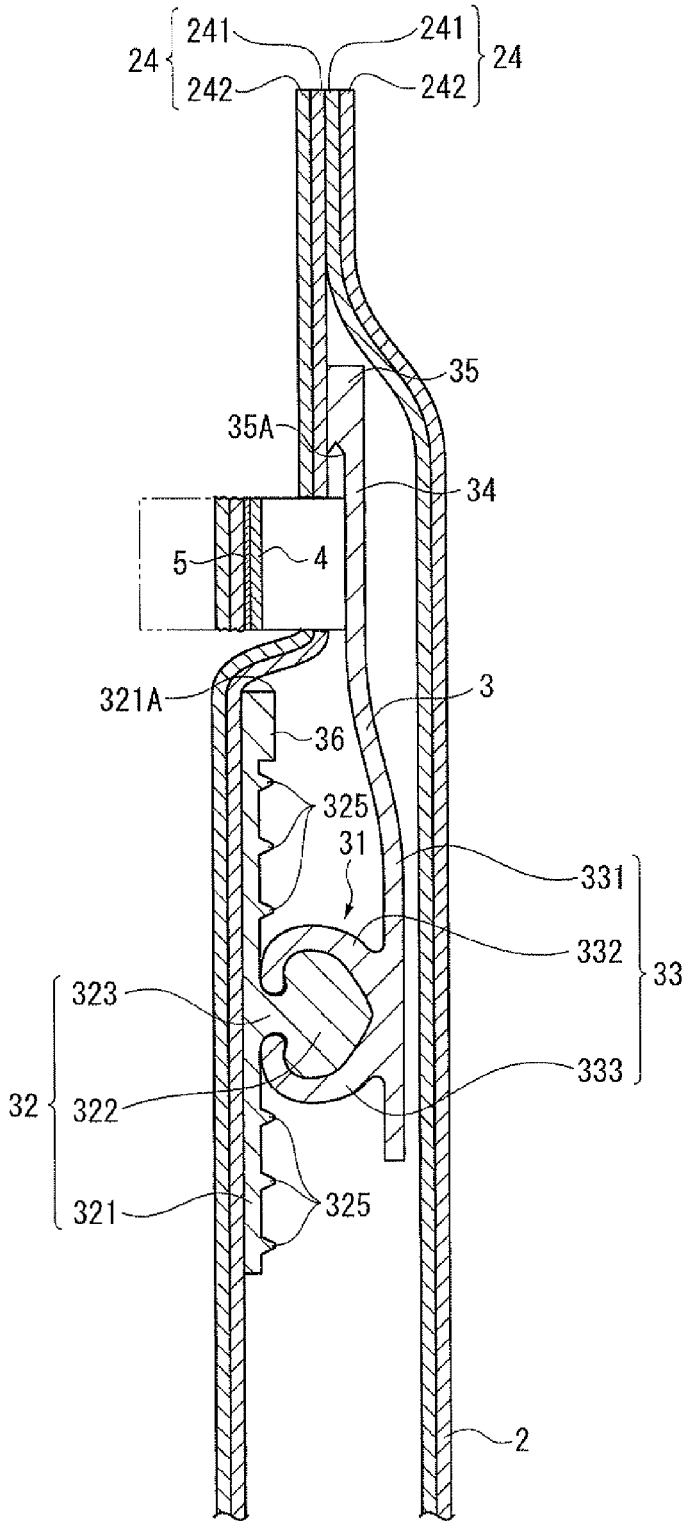
FIG. 4 is a cross section showing the package bag provided with the zipper tape in FIG. 3 that is being opened.

Next, an opening state of the package bag 1 provided with the zipper tape according to this exemplary embodiment will be described below with reference to FIGS. 1 and 4.

As shown in FIG. 1, two cut portions 25 interposing the open tape 4 are respectively provided on the base material film 24 on both ends of the open tape 4.

When being opened, while the end of the open tape 4 that is capable of being pinched by the cut portions 25 and the base material film 24 overlaid on the open tape 4 are pinched, the open tape 4 and the base material film 24 are pulled in a direction away from the bag body 2, so that the base material film 24 of the bag body 2 is cut to open the bag. As shown in FIG. 4, the base material films 24 on both sides of the open tape 4 are cut to be peeled off at between the open tape 4 and the zipper tape 3.

After being cut by the open tape 4, the engagement portion 31 of the zipper tape 3 is disengaged to open the package bag 1 provided with the zipper tape. When being re-closed, the male member 32 and the female member 33 are engaged to bring the engagement portion 31 into an engaged state.

According to the above-described package bag 1 provided with the zipper tape, following effects can be achieved.

(1) In the package bag 1 provided with the zipper tape according to the present exemplary embodiment, the open tape 4 and the seal layer 5 are laminated on the wide portion 34 of the belt-shaped base 331 of the female member 33 and the first projecting portion 35 is formed at the position adjacent to the opening and remote from the open tape 4. Further, the second projecting portion 36 is formed on the opening-side end 321A of the belt-shaped base 321 of the male member 32. Further, these projections are arranged so that a length of a gap provided between the open tape 4 and the first and the second projecting portions 35 and 36 (i.e. the distances between the open tape 4 and the first and the second projecting portion 35 and 36) when the first projecting portion 35, the seal layer 5, and the side of the belt-shaped base 321 opposite to the engagement portion 31 are bonded to the base material film 24 of the bag body 2 becomes 1.0 mm.

Accordingly, the molten resin generated during the bonding is flowed to the gap to be accumulated on the short sides of the first and the second projecting portions 35 and 36. However, since the distances between the open tape 4 and the first and the second projecting portions 35 and 36 are 1.0 mm, the molten resin does not reach to the open tape 4. In other words, since it does not occur that the molten resin reaches to the open tape 4 to unite the open tape 4 and the zipper tape 3, the gap can be securely provided to achieve a desired easy-openability.

Further, both of the first projecting portion 35 and the second projecting portion 36 have a substantially trapezoidal cross section to provide a thick portion. Accordingly, when the base material film 24 of the bag body 2 is cut by the open tape 4, the base material film 24 is cut only at the portion abutted to the gap provided on both sides of the open tape 4 and it does not occur that the zipper tape 3 adjacent to the open tape 4 is cut or stretched. In other words, the base material film 24 can be cut at a predetermined position.

(2) Since the plurality of triangular projections 325 are provided on the side of the engagement portion 31 of the belt-shaped base 321 of the male member 32, the zipper tape 3 can be easily pinched when the engagement portion 31 of the zipper tape 3 is to be disengaged.

(3) Since the open tape 4 and the seal layer 5 are laminated on the zipper tape 3, the open tape 4 and the seal layer 5 can also be simultaneously co-extruded when the zipper tape 3 is manufactured. In other words, the zipper tape provided with the open tape can be obtained in one step, thus reducing the work load and production cost.

Further, when the package bag 1 provided with the zipper tape is manufactured by the zipper-tape-attaching three-side seal bag-making machine, simultaneously with the bonding of the zipper tape 3 to the bag body 2, the first projecting portion 35 and the seal layer 5 can be bonded to the opposing bag body 2 to seal the package bag 1 provided with the zipper tape, so that no special process is required. Accordingly, since the conventional method can be used, no additional work load is required for implementing the invention, thus reducing the production cost.

Figure 5:
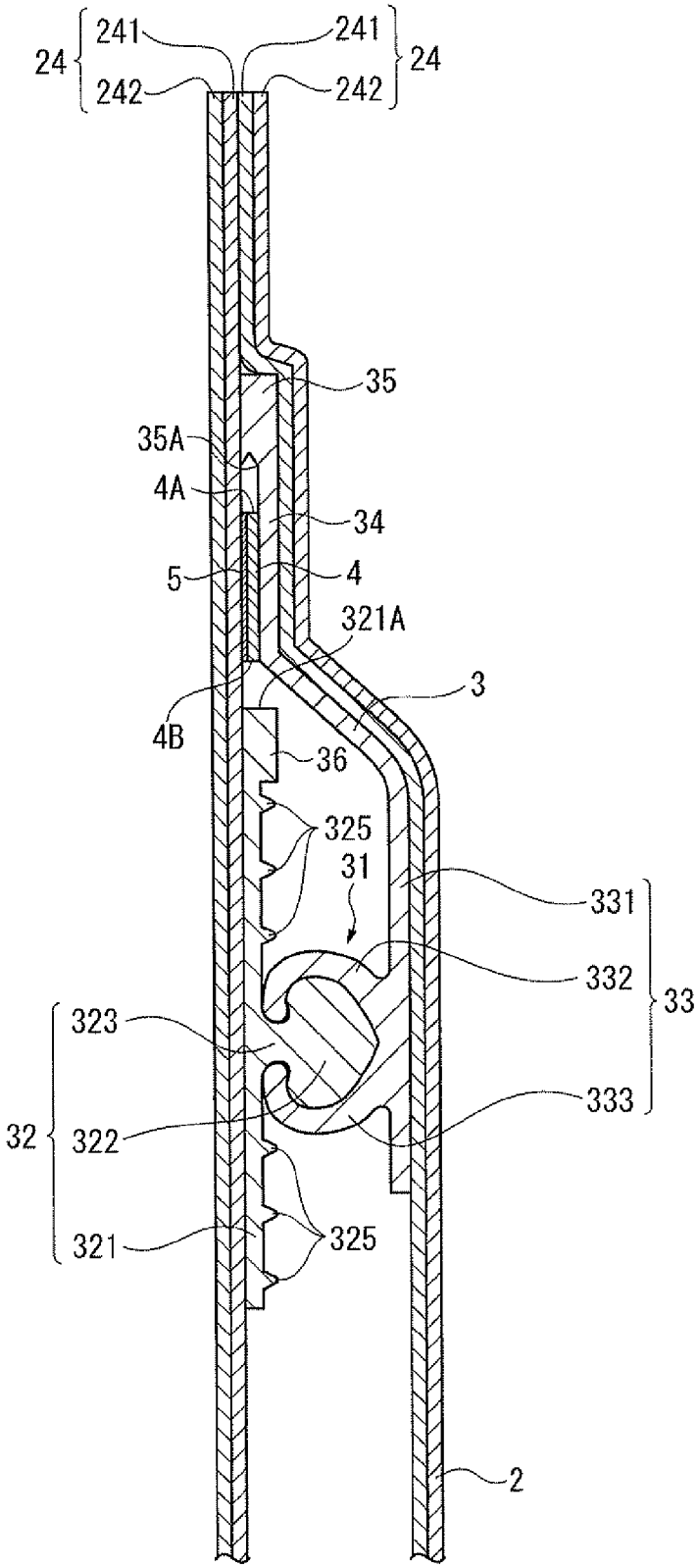
FIG. 5 is a cross section of a zipper tape according to a modification of the first exemplary embodiment.

FIG. 5 shows a cross section of a modification of the above first exemplary embodiment. In the first exemplary embodiment, the belt-shaped base 331 is not bonded to the inner surface of the opposing bag body 2. However, the belt-shaped base 331 may be bonded to the inner surface of the opposing bag body 2 as shown in FIG. 5.

Second Embodiment

Next, a second exemplary embodiment of the invention will be described below with reference to FIGS. 6 and 7. The present exemplary embodiment is the same as the first exemplary embodiment except for the arrangement of the first and the second projecting portions 35 and 36 and bonding of the belt-shaped base 331 to an inner surface of the opposing bag body 2, where the same structure will not be mentioned below.

Figure 6:
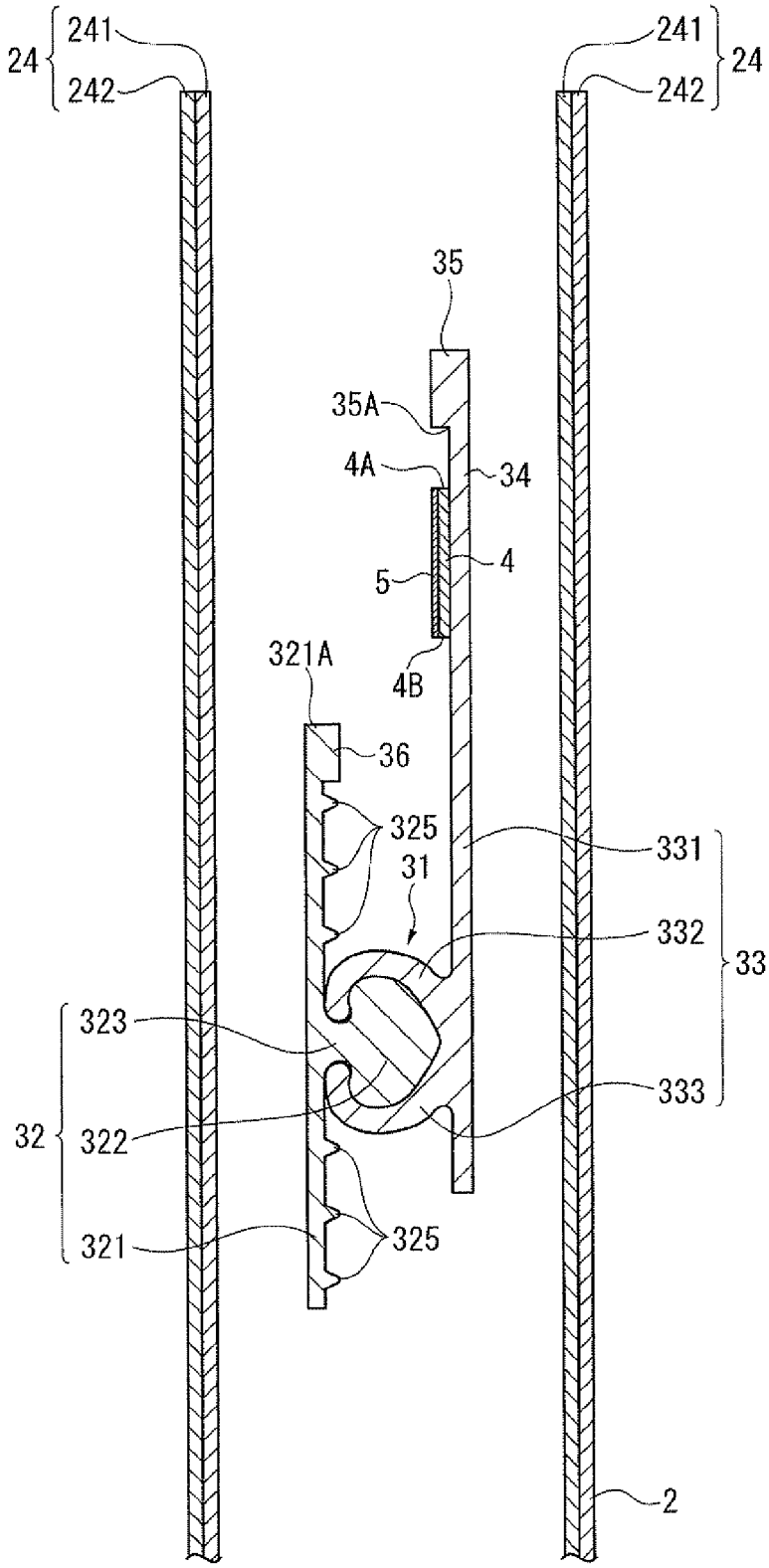
FIG. 6 is a cross section showing a zipper tape according to a second exemplary embodiment of the invention before being bonded to a bag body.
Figure 7:
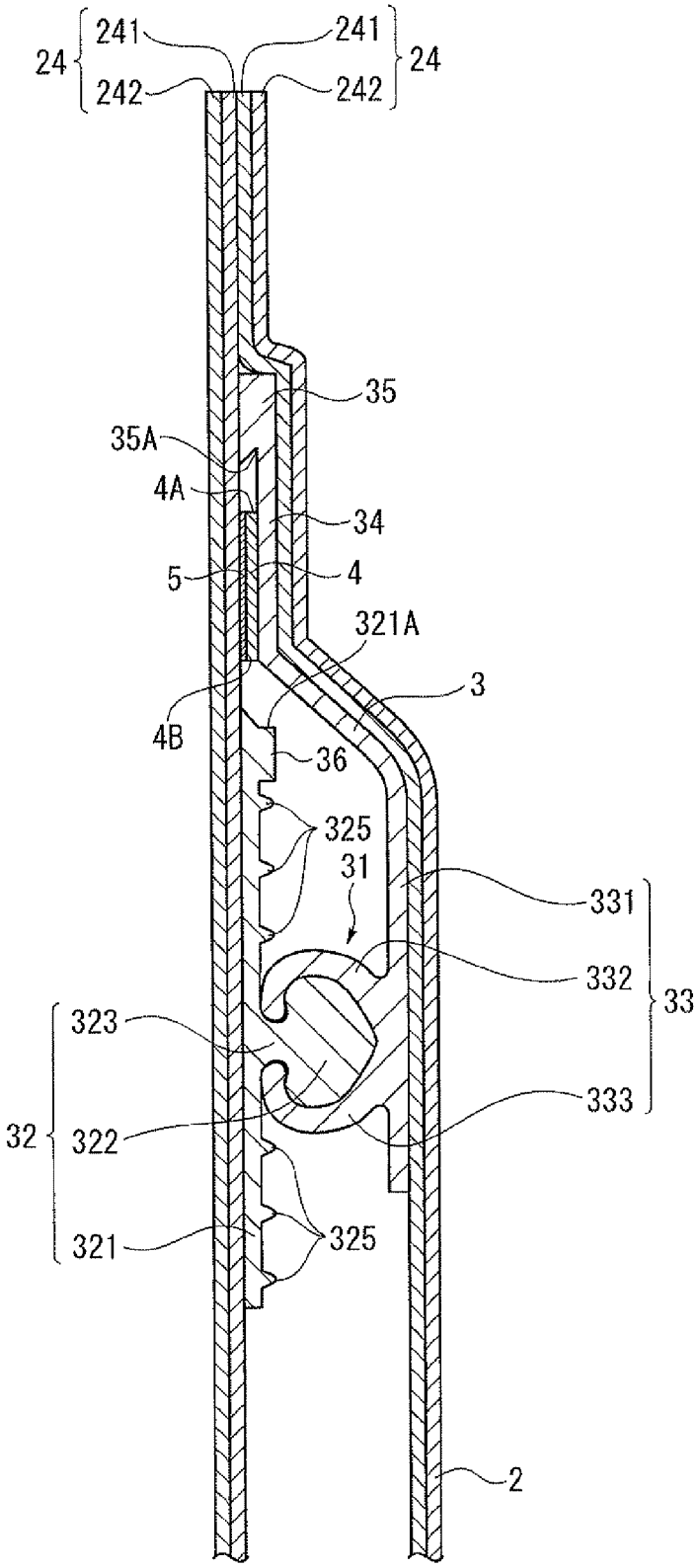
FIG. 7 is a cross section showing the zipper tape of FIG. 6 being bonded to the bag body to seal the bag.

As shown in FIG. 6, in this exemplary embodiment, the cross section of the first projecting portion 35 and the second projecting portion 36 is substantially rectangular and the distance between the open tape 4 and the first and the second projecting portions 35 and 36 is 1.0 mm. According to the above arrangement, when being bonded to the base material film 24 of the opposing bag body 2, the molten resin flow does not reach to the open tape 4 as shown in FIG. 7. Consequently, a gap is reliably provided between the open tape 4 and the first and the second projecting portions 35 and 36.

With the arrangement of this exemplary embodiment, the same advantages as the first exemplary embodiment can be attained.

Incidentally, it should be understood that the scope of the present invention is not limited to the above-described exemplary embodiments but includes modifications and improvements as long as an object and effect of the invention can be achieved. Further, the specific arrangements and configurations may be altered in any manner as long as an object and effect of the invention can be achieved.

Though the first projecting portion 35 and the second projecting portion 36 of the above exemplary embodiments have a substantially trapezoidal or substantially rectangular cross section, the projecting portions may be configured in any shape as long as a gap is provided against the open tape 4 and the projecting portions include a thick portion.

Though the content is packed from the bottom side in the above exemplary embodiments, when only the belt-shaped base 321 of the zipper tape 3 is bonded to the bag body 2, a three-side seal bag having an unsealed section on the side of the opening 23 may be produced, where the content can be put in from the opening 23 and the opening 23 is subsequently sealed.

Further, though the package on which the zipper tape 3 is welded is a three-side seal bag in the above exemplary embodiments, the invention can be also applied to three-side adhesion pillow bag or a four-side seal bag.

EXAMPLE

A tearing resistance was evaluated while changing the distance between the open tape and the projecting portions and the shape of the projecting portion as shown in the following examples and comparatives.

A zipper tape provided with an open tape was obtained by a co-extrusion using a low-density polyethylene (density 926 kg/m$^3$, MFR 1.5 g/10 min) for a zipper tape, polypropylene (density 900 kg/m$^3$, MFR 7.0 g/10 min) for an open tape, and Metallocene LL (density 900 kg/m$^3$, MFR 4.0 g/10 min) for a seal layer laminated on a surface of an open tape.

A film in which the zipper tape, a 15 μm thick biaxially oriented nylon film and a 50 μm thick linear low-density polyethylene film were dry-laminated was formed in a bag using a zipper-tape-attaching three-side bag-making machine. Then, cut portions were provided on both ends of the open tape to obtain a package bag provided with a zipper-tape.

While varying the shape of the projecting portions and the distance between the projecting portions and the open tape as in the following Example 1, Example 2 and Comparative 1, the tearing resistance and the time required for manufacturing the bag were evaluated.

Example 1

Profile of the projecting portion: trapezoid

Distance between the projecting portions and the open tape: 1.0 mm

Example 2

Profile of the projecting portion: rectangle

Distance between the projecting portions and the open tape: 1.0 mm

Comparative 1

Profile of the projecting portion: rectangle

Distance between the projecting portions and the open tape: 0.4 mm

Comparative 2

After the open tape and the zipper tape of the zipper tape provided with the open tape were separately obtained by co-extrusion, the open tape was post-attached to obtain a package bag provided with a zipper tape.

In samples prepared according to the conditions of the Examples 1 and 2 and the Comparatives 1 and 2, an end of the open tape interposed between cut portions was pulled to cut the base material film of the bag body together with the open tape.

Then, the tearing resistance in opening the open tape and the time required for manufacturing the bag were measured. The evaluation was conducted according to the following standard.

[Evaluation of Tearing Resistance]

Grade: Condition

A: Capable of being easily cut from the cut portion

B: Felt resistance in cutting

[Time Required for Manufacturing a Bag]

Grade: Condition

A: Five minutes or less

B: More than five minutes

TABLE 1

| | Tearing Resistance | Time Required for Manufacturing Bag | Overall Judgment |
|---|---|---|---|
| Example 1 | A | A | A |
| Example 2 | A | A | A |
| Comparative 1 | B | A | B |
| Comparative 2 | A | B | B |

The bag according to the Examples 1 and 2 could be easily cut without feeling tearing resistance. The time required for manufacturing a bag was five minutes or less, which posed no practical problem.

The bag according to the Comparative 1 exhibited great tearing resistance, which could not be easily cut.

The bag according to the Comparative 2 exhibited sufficiently small tearing resistance. However, it took more than five minutes to manufacture the bag, which was far from being practical.

The invention claimed is:

1. A zipper tape that is attached to an inner surface of a package bag, comprising:

an engagement portion at which a pair of male member and a female member are mated with each other;

and belt-shaped bases provided continuously to the engagement portion, wherein one of the belt-shaped bases has a wide portion that extends wider toward an opening of the package bag than the other of the belt-shaped bases, an open tape is laminated on a surface of the wide portion adjacent to the engagement portion, a seal layer that is adapted to be bonded to the bag body is provided on a surface of the open tape, a first projecting portion is provided on the wide portion at a position adjacent to the opening of the package bag and remote from the open tape, a second projecting portion is provided on an opening-side end of the other of the belt-shaped bases on which the open tape is not provided, and the first projecting portion, the seal layer laminated on the open tape and a surface of the other of the belt-shaped bases opposite to the engagement portion are adapted to be bonded to the inner surface of the bag body while providing a gap between the open tape and the first and the second projecting portions.

2. The zipper tape according to claim 1, wherein the gap is so formed that a distance between the open tape and the first projecting portion and a distance between the open tape and the second projecting portion are respectively 0.5 mm or more.

3. The zipper tape according to claim 1, wherein the first projecting portion and the second projecting portion are substantially trapezoidal in cross section.

4. The zipper tape according to claim 1, wherein the first projecting portion and the second projecting portion are substantially rectangular in cross section.

5. The zipper tape according to claim 1, wherein the open tape is laminated on either one of the male member and the female member.

6. A package bag on which the zipper tape according to claim 1 is attached.

7. A manufacturing method of the zipper tape according to claim 1, comprising:

co-extruding a material of the zipper tape, a material of the open tape and a material of the seal layer.

* * * * *